United States Patent [19]

Vandeweghe et al.

[11] Patent Number: 4,708,174

[45] Date of Patent: Nov. 24, 1987

[54] WEFT GRIPPER FOR WEAVING MACHINE

[75] Inventors: Michel M. J. Vandeweghe, Heuvelland; Johnny-Fredy-Maurice Victoor, Langemark; Remi-Louis Lagache, Voormezele-Ieper, all of Belgium

[73] Assignee: N.V. Weefautomaten Picanol, Belgium

[21] Appl. No.: 849,445

[22] Filed: Apr. 8, 1986

[30] Foreign Application Priority Data

Apr. 9, 1985 [BE] Belgium ..... 2/60661

[51] Int. Cl.[4] ..... D03D 47/20

[52] U.S. Cl. ..... 139/448

[58] Field of Search ..... 139/447, 448

[56] References Cited

U.S. PATENT DOCUMENTS

| | | | |
|---|---|---|---|
| 3,386,477 | 6/1968 | Durand . | |
| 3,580,291 | 5/1971 | Piccoli . | |
| 3,688,807 | 9/1972 | Parolini | 139/448 |
| 3,998,251 | 12/1976 | Handam | 139/448 |
| 4,129,155 | 12/1978 | Merisio | 139/448 |
| 4,632,152 | 12/1986 | Pezzoli | 139/448 |

FOREIGN PATENT DOCUMENTS

| | | | |
|---|---|---|---|
| 137377 | 4/1985 | European Pat. Off. | 139/448 |
| 1388474 | 12/1964 | France . | |
| 1444834 | 3/1966 | France | 139/448 |
| 1480561 | 4/1967 | France . | |
| 1559836 | 2/1969 | France . | |
| 2202964 | 5/1974 | France . | |
| 44327 | 3/1966 | German Democratic Rep. | 139/448 |
| 742498 | 6/1980 | U.S.S.R. | 139/448 |

*Primary Examiner*—Henry S. Jaudon

*Attorney, Agent, or Firm*—Bacon & Thomas

[57] ABSTRACT

An improved weft carrying/feeding gripper for weaving machines, consisting of two components which are biased together by a spring device, and wherein one of the contact areas of at least one of the components comprises a resilient component (6), and wherein the setting of the pretension of the resilient component (6) is adjustable. The weft is thus held firmly in a direction along its length between the contact areas, and loosely in a weft feeding direction.

13 Claims, 10 Drawing Figures

WEFT GRIPPER FOR WEAVING MACHINE

BACKGROUND OF THE INVENTION

1. Field of the Invention

This invention concerns improved feeding and carrying grippers for weaving machines, in particular, feeding and carrying grippers, the former being designed to guide a weft thread through the first half of a shed gap, and the latter to guide a weft thread through the second half of the gap.

In particular, the invention concerns a clamping device for weft threads which can be embodied in each of these grippers.

2. Description of Prior Art

It is known that an important cause of malfunctions in gripper weaving machines is the loss of the weft thread from the clamping device of one or both feeding and carrying grippers. This problems occurs most frequently because the clamping devices of the existing grippers do not react in an optimal manner to the different types of weft yarn; for example, different thickness yarns, or are not suitable to clamp the weft thread in an effective and reliable manner, when there are differences in the tension in the weft thread in the face of vibrations in the weaving machine.

Efforts have been constantly made to develop grippers with improved clamping devices. Improved grippers for weft gripper weaving machines are known in which the clamping device consists of two components pressed together by means of a resilient component, such that the contact surfaces of these components form a wedge-shaped opening in order to permit feeding of the weft thread to the contact area of the components pressed together. In this case, one of these components is usually firmly fastened to the body of the grippers, while the other component is moveable along the first, and can, for example, rotate or slide relative to it. The components can also be resilient relative to one another.

In a known alternate of this embodiment, the contact surface of one of the two components is provided with a compressible material.

A disadvantage of this known embodiment lies in the fact that the contact surfaces of the components involved do not usually offer a perfect joint as a result of tolerance deviations, so that it is impossible to clamp the weft yarn with a fixed or constant force.

In order to find a solution for this problem, weft grippers were devised in which the clamping device consists of two components which are pressed together by means of a resilient component, with the characteristic that at least one of the contact surfaces formed between the two aforementioned components is L-shaped.

These devices have the disadvantage that the weft thread, when clamped, is folded out of true, such that it is usually damaged, and is prone to breakage.

Grippers are also known in which the clamping devices are provided by opposed V-shaped profiled contact surfaces, wherein one of the contact surfaces has a V-shaped recess, while the other contact surface is formed of a V-shaped projection.

This type of device also presents the disadvantage that, in the event of the slightest irregularity during the weft feeding cycle, the weft thread will be damaged or broken.

BRIEF SUMMARY OF THE INVENTION

The present invention concerns improved weft grippers for weaving machines, more particularly an improved clamping device for the weft yarn, which is intended to eliminate the aforementioned disadvantages, and other disadvantages of the known clamping devices for feeding and carrying grippers.

For this purpose, these improved grippers for weaving machines according to the invention consist primarily of a gripper body and a clamping device for weft yarn, such that the clamping device consists principally of a combination of a first rigid component which is fastened to the gripper body or which forms a whole body; a second, moveable, component; resilient means to press the second component against the aforementioned first component, such that the contact thus achieved is in two contact areas, on the first and second components respectively, so that the weft thread can be clamped between the contact parts; and a resilient component mounted on one of the two components and defining the contact area of that component.

DESCRIPTION OF THE DRAWINGS

With a view to giving a better illustration of the characteristics of the invention, a number of preferred embodiments are described below, as examples, without any limitative nature. With reference to the accompanying drawings.

DETAILED DESCRIPTION OF THE PREFERRED EMBODIMENTS

Figure 1:
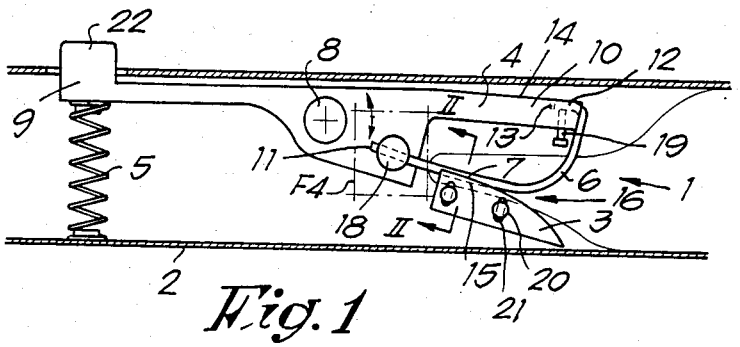
FIG. 1 represents schematically an exemplary cross-section view of a clamping device that embodies this invention.

According to the invention, the improvement to both feed grippers and carrying grippers resides in the clamping device 1, which is connected to the typical gripper body 2, as is shown primarily in FIG. 1.

This clamping device consists of a first rigid component formed by a bit 3; a second rigid component, which is, however, moveable relative to the gripper body 2, and is formed by an articulated arm 4; resilient means for pressing the second component against the first, consisting, in this embodiment, of a compression spring 5, and a resilient component consisting of an elongate wire spring 6, which engages bit 3 in a cooperative relationship described more fully below.

The contact areas between which the weft thread is intended to be clamped are formed here by the wire spring 6 having a round cross-section in this embodiment, and the upper surface of the bit 3.

The arm 4 is attached to the gripper body 2 by means of a pivot 8, and, at its rear end 9, the arm is forced to rotate in one direction by means of a compression spring 5, such that the forward end 10 of the arm 4 is forced (i.e., biased) into making contact with the upper surface 7 of the bit 3. This causes the wire spring 5, which is relatively flexible, to be firmly attached to the arm 4 at one extermity 11, while the opposite extremity 12 is loosely held in a groove 13 in the upper side 14 of the arm 4. The wire spring 6 is bent in a bow such that it can make suitable contact with the upper surface 7 of the bit 3.

Figure 2:
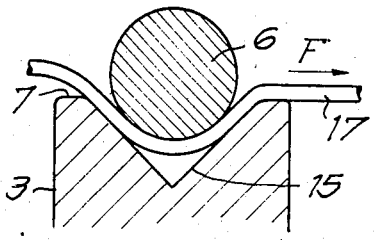
FIG. 2 represents a sectional view taken along line II—II in FIG. 1, in which the clamping of the weft yarn is shown.

The upper surface 7 of the bit 3 is preferably provided with a V-shaped groove 15 in which the spring wire spring 6 can lie, as shown in FIG. 2.

Figure 3:
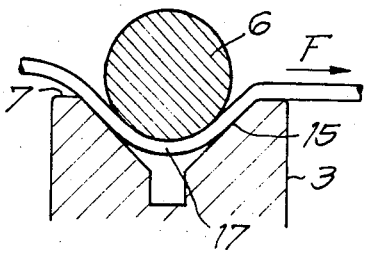
FIG. 3 represents an alternate embodiment of the invention.

Both contact areas, that is, the wire spring 6 and the upper surface 7, are so designed that, at their weft engaging ends, a wedge-shaped opening 16 is created, whereby it is possible for a weft thread 17 offered up to the gripper to be engaged and clamped between the two areas. The use of contact areas formed by a V-shaped groove 15 and a wire spring 6 offers the advantage that, as shown in FIG. 2, the weft yarn 17, during transfer to the gap, is firmly clamped, as a relatively strong force F is necessary to pull this thread free in a direction transverse to that of the wire spring 6, so that, in this direction, the system is self-clamping. On the other hand, when the weft thread is transferred from the feed gripper to the carrying gripper, the weft thread 17 can easily be pulled free of the former, as a traction force used in this operation acts in a direction parallel to the longitudinal axis of the wire spring 6 (along the weft feed direction), and the weft thread therefore moves largely freely under the spring 6. This effect is further aided by the use of a profiled groove, as shown in FIG. 3.

Another advantage of the aforementioned construction is that an ideal continuous wedge shape for the clamping of the weft thread is obtained through the use of such a resilient component for defining one of the contact areas. During testing, clamping device 1 has proved very efficient for uses in weaving processes in which an irregular thread is used, for example, a pile.

It has also been established that, by pretensioning the resilient component, in this case the wire spring 6, the clamping of the weft thread 17 can be varied and controlled. The setting or adjustable of this pretension can, be achieved in a number of different ways. A few adjustment components, with which this pretension can be set to different values controlled, are described below to serve as examples.

The wire spring 6 is bent to a greater or lesser degree by rotating the pin 18, and, as a result of this, an increased or reduced pretension is obtained.

According to another possibility, an adjustment device can also be provided at the second extremity of the wire spring, which might, for example, consist of a screw 19 attached to the forward extremity 10 of the arm 4, such that the extremity 12 of the spring 6 can be pushed up or down in the groove 13 by screwing further in, or less far in, the screw 19.

Another type of adjustment which proved very efficient for setting the force with which the weft thread 17 is gripped to different values consists of adjusting the width of the wedge-shaped opening 16. This can easily be achieved by making the bit 3 adjustable, such that its upper surface 7 can be set to different angles.

In FIG. 1, such an arrangement is provided by attaching the bit 3 to the body of the gripper 2 by means of screws 20 and slots 21. Of course, the point at which the thread will be located when being clamped will be determined by the adjustment of the bit 3.

The application of a resilient component with adjustable pretension also offers the advantage that the clamping force with which the weft thread 17 is gripped in the clamping device 1 can be easily adjusted without it being necessary to modify the tension of the compression spring 5.

The fact that the extremity 12 of the resilient component, i.e., of the wire spring 6, engages behind the forward end 10 of the arm 4 offers the advantage that this component moves only slightly when the clamping device 1 is opened, for example by exerting a force on the compression component 22, or, in other words, that only a small angular rotation of the arm 4 is required to free completely the wedge-shaped opening 16.

Figure 4:
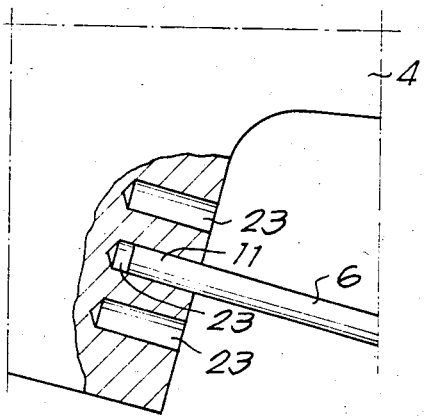
FIG. 4 represents a detail view of an alternate form of the detail area marked F4 in FIG. 1.
Figure 7:
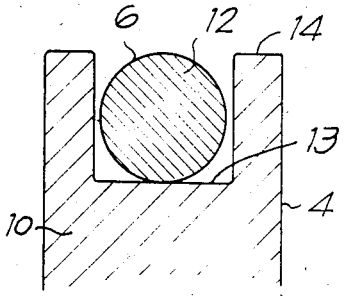
FIG. 7 represents a sectional view along line VII—VII in FIG. 6.

In FIG. 4, a further possibility for adjustment of the pretension in the wire spring 6 is provided. In this system, the arm 4 is provided with a number of openings 23, in any one of which the extremity of the wire spring 6 can be fastened and/or clamped, thus setting the pretension at one of several different values.

Figure 5:
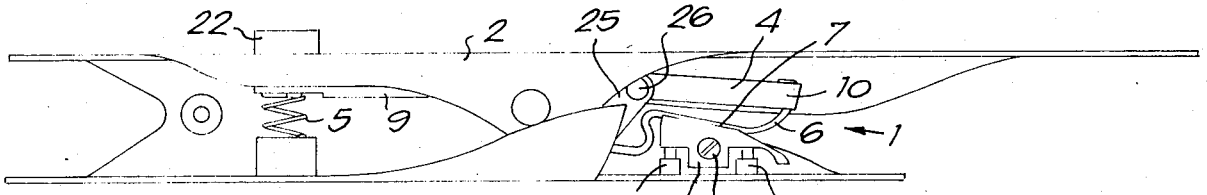
FIG. 5 represents a view of a feeding gripper embodying the invention.
Figure 6:
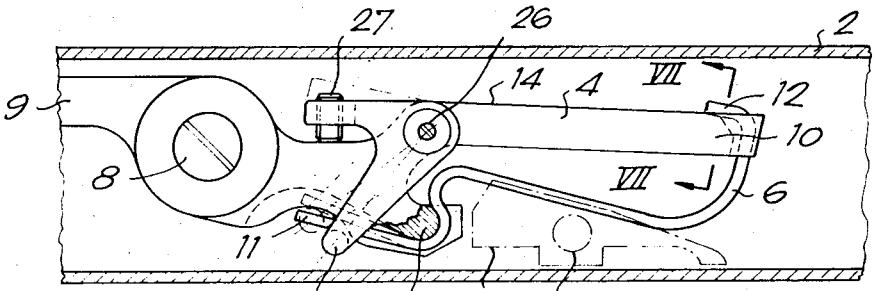
FIG. 6 represents a detail cross-section view of the gripper of the clamping device shown in FIG. 5.

In FIGS. 5 and 6, a detailed alternate embodiment of a gripper embodying the invention, more particularly a feed gripper, is represented. In this case, the wire spring 6 is bent several times, such that a section of it is folded over a projection 24 in such a way that the free extremity 11 of the wire spring 6 can be rotated about this extremity to modify the pretension by deformation of the free extremity. The setting of the pretension, or in other words, the displacement of the extremity 11 of the wire spring 6, is achieved by means of a lever 25, attached to the arm 4 by means of a pivot point 26, and adjustable relative to the arm by means of a set screw 27.

The bit 3 can also be tilted by means of a pivot point 28 attached to the body of the gripper 2, and can be set at various angles relative to the body of the gripper 2 by means of two set screws 29.

Figure 8:
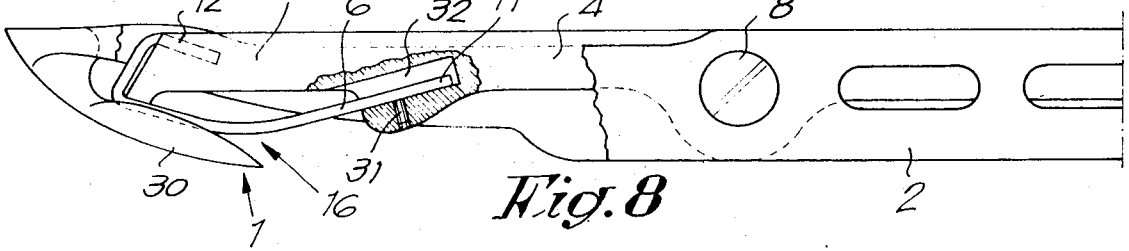
FIG. 8 represents a partial sectional view of a carrying gripper embodying the invention.

In FIG. 8, another embodiment of the invention, more particularly a carrying gripper, is represented. Here a pivoting arm, also referenced 4, is provided. Analogously to the feed gripper, this arm 4 is also eqipped with a wire spring 6 which, in this case, can come into contact with the pin or hood 30, which, as is generally known, is present in this type of gripper, and which, so to speak, forms the bit 3. In addition, a bit 3, as previously described, can be attached to the hook 30, and may or may not be adjustabale. The adjustment of the pretension in the resilient component or the spring 6 is performed by means of a set screw 31.

For this purpose, the spring 6 is firmly fastened to the forward end 10 of the arm 4 by its extremity 12, while the opposite extremity 11 of the spring 6 is held in a recess 32, with a fixed amount of play, such that the bending of the wire spring 6 can be achieved by screwing in a set screw 31. It will be noted that the extremity 1 of the aforementioned spring 6 can also obviously be adjustably fastened in order to adjust the pretension of the spring 6.

The aforementioned embodiments present the advantage that the use of a wire spring 6 offers the possibility of replacing the spring in a relatively simple manner with another. Thus, it is possible, on the one hand, to work with springs with different pretensions, and, on the other hand, in the event of wear, the spring can be simply replaced with a new spring.

In view of the low cost price of this type of wire spring 6, repair costs are very economical.

It is clear that a large number of alternates are possible without departing from the central invention. For example, the contact components need not necessarily be formed of a V-shaped groove 15 and a round wire spring 6, but, as an example, this groove can have any form whatever which is adapted to the form of the cross-section of the resilient component which comes in contact with it.

It is clear that component 3 can also be resilient. It is also clear that the pretension slot and the thread clamping device can be interverted.

It is also self-evident that the wire spring 6 can be made of a wire of cylindrical cross-section, or of any other cross-section whatever.

Figure 9:
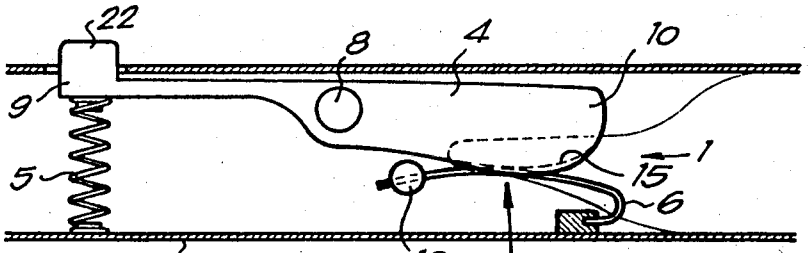
FIGS. 9 and 10 show other alternate embodiments of the invention.
Figure 10:
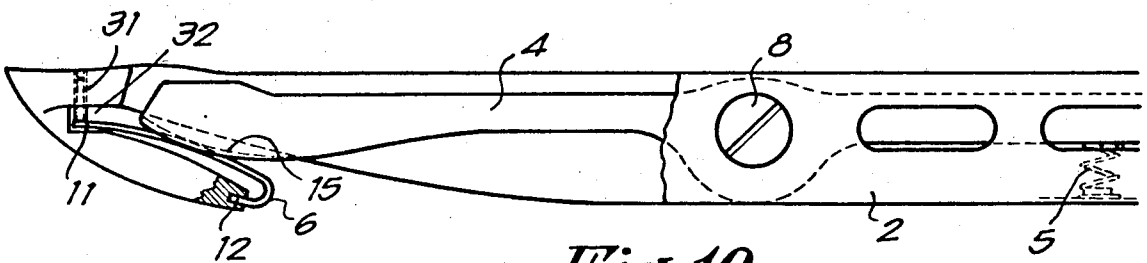

According to an important alternate, the resilient component 6 is not attached to the two aforementioned moveable components 4 (FIGS. 1 and 8), but is fastened to the fixed component secured to the gripper body. As shown in FIGS. 9 and 10, the wire spring 6 is then fastened to the component fixed to the gripper and the extremity 10 of the arm 4 is provided with a V-shaped groove 15 to serve as a clamping bit with spring 6.

The present invention is in no way limited to the embodiments described as examples and represented in the accompanying drawings. Such improved grippers for weft gripper weaving machines, and the assembled components thereof, can, in fact, be constructed in a wide range of forms and dimensions without stepping outside the scope of the invention.

What is claimed is:

1. A weft gripper for a weft gripper weaving machine comprising a gripper body;

a weft clamp mounted on the gripper body and including a pair of components, one of which is movable relative to the gripper body and the other of which is fixed relative to the gripper body; said movable component being movable towards and away from the fixed component; said components defining a pair of contact areas between which a weft thread may be clamped;

spring biasing means for normally urging the components towards each other;

a resilient element attached to a first one of said components and defining at least in part one of said contact areas;

said resilient element being pretensioned to resist movement of the movable component toward the other component as the respective contact areas approach and engage each other;

adjustabale pretension control means carried by the gripper for varyingi said pretensions of said resilient element; said resilient element comprising an elongate spring element bowed to product said pretension;

said adjustable pretension control means comprising means for varying the degree of bowing of said resilient element.

2. The weft gripper according to claim 1, wherein the resilient element is attached to the fixed component.

3. The weft gripper according to claim 1, wherein the resilient element is attached to the movable component.

4. The weft gripper according to claim 1, wherein the weft approach side of the contact areas is a wedge-shaped opening converging towards the clamping areas, the edges of the opening being defined by a portion of the resilient element and a portion of the component to which the resilient element is not attached, and including position adjusting means for varying the angular position of the component to which the resilient element is not attached so as to vary the angle of convergence of said wedge opening.

5. The weft gripper according to claim 1 or 2, wherein said movable component is an elongated arm pivotally secured to the gripper body.

6. The weft gripper according to claim 1, wherein said means for normally urging said components towards each other comprises a compression spring.

7. The weft gripper according to claim 1 or 4, wherein said clamping areas are elongated, and said resilient element comprises a wire spring extending generally parallel to the clamping areas.

8. The weft gripper according to claim 7, wherein the wire spring is attached at one end to said first one component carrying same and engages said first one component at its opposite end so as to be restrained thereby, said opposite end shaped like a hook for engaging said first one component at a complimentary engaging area.

9. The weft gripper according to claim 7, wherein the wire spring is attached at one end to said first one component carrying same and engages the same component at its opposite end, said first one component including a spring receiving groove, said opposite end of said wire spring engaging said groove so as to be restrained thereby.

10. The weft gripper according to claim 7, including a rotatable pin mounted on said first one component carrying the wire spring; said wire spring attached at one end to said pin and at its other end to said first one component; said adjustable pretension control means comprising means for adjusting the rotational position of said pin; said pin and wire spring connected together in such a manner that rotation of said pin varies the pretension of said wire spring.

11. The weft gripper according to claim 7, wherein said adjustable pretensioned control means comprising a screw threaded element on the said first one component carrying said wire spring, said screw threaded element arranged to advance or withdraw one end of the wire spring towards or away from said first one component, the other end of said wire spring also being attached to said first one component.

12. The weft gripper according to claim 7, wherein said gripper is a feeding gripper; said fixed component is a bait element; said movable component comprising an elongate arm having a forward end disposed towards the weft feed direction of the gripper and comprising said first one component carrying said resilient element; the means for urging the components towards each other comprises a compression spring; said wire spring bent into a hook at one end and arranged to engage a complimentary projection on the forward end of said arm, and bent at its opposite end area over a projection provided on said arm; said adjustable pretension control means for said spring wire comprising a lever engaging the bent-over end of said wire spring; and means for adjusting the position of the lever relative to the wire spring bent-over end.

13. The weft gripper according to claim 1; wherein said clamping areas are elongated, and said resilient element comprises an elongate bowed wire spring extending generally parallel to the clamping areas, and wherein said gripper is a carrying gripper, said fixed component is a weft receiving hook; the movable component comprising a pivoted arm; said means for urging the components together comprising a compression spring; said wire spring having one end affixed to said arm and an opposite end disposed in a recess provided in said arm; said adjustable pretension control means comprising a set screw engaging said opposite end of said wire spring and arranged to cause bending of the wire spring over its length when advanced towards the wire spring opposite end.

* * * * *